US012042688B1

(12) United States Patent
Lewis-Dove

(10) Patent No.: US 12,042,688 B1
(45) Date of Patent: Jul. 23, 2024

(54) VERSATILE COMPACT UNIVERSAL GYM WITH DOOR OR DOORS

(71) Applicant: Stacey M. Lewis-Dove, Charleston, SC (US)

(72) Inventor: Stacey M. Lewis-Dove, Charleston, SC (US)

(73) Assignee: Gym-in-a-Box LLC, Moncks Corner, SC (US)

( * ) Notice: Subject to any disclaimer, the term of this patent is extended or adjusted under 35 U.S.C. 154(b) by 0 days.

(21) Appl. No.: 17/670,607

(22) Filed: Feb. 14, 2022

Related U.S. Application Data

(60) Provisional application No. 63/149,305, filed on Feb. 14, 2021.

(51) Int. Cl.
*A63B 21/16* (2006.01)
*A63B 17/04* (2006.01)
(Continued)

(52) U.S. Cl.
CPC ..... *A63B 21/16* (2013.01); *A63B 17/04* (2013.01); *A63B 21/00047* (2013.01);
(Continued)

(58) Field of Classification Search
CPC . A63B 21/16; A63B 2210/50; A63B 2210/06; A63B 21/00047; A63B 2210/58;
(Continued)

(56) References Cited

U.S. PATENT DOCUMENTS 4,898,381 A 2/1990 Gordon
6,443,877 B1 9/2002 Hoecht et al.
(Continued)

FOREIGN PATENT DOCUMENTS

CN 202506050 U 10/2012
CN 203886099 U 10/2014
(Continued)

OTHER PUBLICATIONS

First Office Action with English translation for Chinese Patent Application No. 201880092314.5 dated Apr. 8, 2021 (4 pages).
(Continued)

*Primary Examiner* — Megan Anderson
(74) *Attorney, Agent, or Firm* — Thrive IP®; Jeremy M. Stipkala

(57) ABSTRACT

An apparatus for exercising against a resistance comprises a frame comprising a plurality of vertical members mutually supporting a plurality of horizontal members, wherein the frame has at least a front face joining a side face at a corner; one or more doors comprising one or more door vertical members mutually supporting one or more door horizontal members, the door being pivotally and optionally slidably mounted to the frame in at least one point; wherein the frame and optionally the door provide at least one exercise attachment point. A hinge, useful for example in such an apparatus, comprises a frame brace rotatably joined to a door brace by a hinge axle, wherein the frame brace is adapted to slidably engage a track affixed to the frame of the apparatus.

19 Claims, 12 Drawing Sheets

(51) Int. Cl.
*A63B 21/00* (2006.01)
*A63B 71/00* (2006.01)

(52) U.S. Cl.
CPC ..... *A63B 21/1618* (2013.01); *A63B 21/1636* (2013.01); *A63B 21/1645* (2013.01); *A63B 71/0036* (2013.01); *A63B 2210/50* (2013.01); *A63B 2225/105* (2013.01)

(58) Field of Classification Search
CPC ..... A63B 2225/10; A63B 21/00; A63B 21/06; A63B 2210/00; A63B 2210/10; A63B 1/00; A63B 1/005; A63B 17/00; A63B 17/02; A63B 17/04; A63B 21/1618; A63B 21/1627; A63B 21/1636; A63B 21/1645; A63B 21/1663; A63B 21/169; A63B 71/0036; A63B 71/02; A63B 71/023; A63B 2225/105
See application file for complete search history.

(56) References Cited

U.S. PATENT DOCUMENTS

| | | | | |
|---|---|---|---|---|
| 6,497,548 | B1 | 12/2002 | Roy | |
| 6,527,683 | B2 | 3/2003 | Tolles | |
| 6,994,661 | B1 | 2/2006 | Dawson | |
| 7,601,105 | B1 | 10/2009 | Gipson, III et al. | |
| 7,628,734 | B1 | 12/2009 | Proctor | |
| 7,766,803 | B2 | 8/2010 | Carter | |
| D635,206 | S | 3/2011 | Henniger | |
| D636,038 | S | 4/2011 | Henniger | |
| D636,039 | S | 4/2011 | Henniger | |
| D636,040 | S | 4/2011 | Henniger | |
| 8,057,368 | B1 | 11/2011 | Lyszczarz | |
| 8,172,736 | B2 | 5/2012 | Contreras | |
| 8,506,459 | B2 | 8/2013 | Cassidy et al. | |
| 8,663,075 | B2 | 3/2014 | Reyes | |
| 8,727,952 | B1 | 5/2014 | Carle | |
| 9,586,081 | B2 | 3/2017 | Lagree et al. | |
| 9,713,738 | B2 | 7/2017 | Shrag | |
| D852,907 | S | 7/2019 | Sergakis | |
| D883,406 | S | 5/2020 | Sergakis | |
| 10,709,921 | B2 | 7/2020 | Risacher | |
| D898,844 | S | 10/2020 | Sergakis | |
| 10,806,963 | B2 | 10/2020 | Staten | |
| 10,926,151 | B2 | 2/2021 | Dunahay | |
| D928,253 | S | 8/2021 | Dunahay | |
| D931,955 | S | 9/2021 | Dunahay | |
| D952,776 | S | 5/2022 | Adams | |
| D955,512 | S | 6/2022 | Sergakis | |
| D963,083 | S | 9/2022 | Dunahay | |
| 11,446,535 | B1 | 9/2022 | Iverson et al. | |
| D970,656 | S | 11/2022 | Gong | |
| D973,155 | S | 12/2022 | Gong | |
| D976,346 | S | 1/2023 | Pritchett et al. | |
| 11,673,036 | B2 * | 6/2023 | Dalebout | A63B 21/151 312/234 |
| D992,063 | S | 7/2023 | Dunahay | |
| D1,001,216 | S | 10/2023 | Yang | |
| D1,005,419 | S | 11/2023 | Yang | |
| 2002/0091043 | A1 | 7/2002 | Rexach | |
| 2004/0046488 | A1 * | 3/2004 | Hogan | E06B 3/5045 312/322 |
| 2007/0054785 | A1 | 3/2007 | Drechsler | |
| 2007/0155595 | A1 | 7/2007 | Rogers et al. | |
| 2007/0173384 | A1 | 7/2007 | Sechrest et al. | |
| 2010/0022363 | A1 | 1/2010 | Fenster et al. | |
| 2010/0267527 | A1 | 10/2010 | Luquette | |
| 2011/0028281 | A1 | 2/2011 | Ish, III et al. | |
| 2011/0245049 | A1 | 10/2011 | Keiser | |
| 2012/0035026 | A1 | 2/2012 | Lyszczarz | |
| 2014/0135182 | A1 | 5/2014 | Inglut | |
| 2014/0243174 | A1 | 8/2014 | Alendaaf | |
| 2015/0141219 | A1 | 5/2015 | Bellevue | |
| 2017/0021215 | A1 | 1/2017 | Norris | |
| 2018/0117382 | A1 | 5/2018 | Johanson et al. | |
| 2019/0151698 | A1 | 5/2019 | Olson et al. | |
| 2019/0240521 | A1 | 8/2019 | Staten | |
| 2019/0269992 | A1 | 9/2019 | Dunahay | |
| 2020/0114195 | A1 | 4/2020 | Henniger | |
| 2020/0384337 | A1 | 12/2020 | Brasch | |
| 2020/0391070 | A1 | 12/2020 | Henniger | |
| 2021/0170218 | A1 | 6/2021 | Lewis-Dove | |
| 2022/0016466 | A1 | 1/2022 | Henniger | |

FOREIGN PATENT DOCUMENTS

| | | | | |
|---|---|---|---|---|
| CN | 107297050 | A | 10/2017 | |
| CN | 206587342 | U | 10/2017 | |
| CN | 107694041 | A | 2/2018 | |
| GB | 2560551 | A * | 9/2018 | A63B 21/02 |
| GB | 6245516 | | 11/2022 | |
| JP | 58-190453 | A | 11/1983 | |
| JP | 62-179478 | A1 | 8/1987 | |
| JP | 2-243170 | A | 9/1990 | |
| JP | 2004-520897 | A | 7/2004 | |
| JP | 2012-110420 | A | 6/2012 | |
| JP | 2013-526979 | A | 6/2013 | |
| KR | 10-1776498 | B1 | 9/2019 | |
| RU | 2557745 | C1 | 7/2015 | |
| WO | WO-2009003280 | A1 * | 1/2009 | A63B 21/0628 |
| WO | 2014/146710 | A1 | 9/2014 | |
| WO | 2019/199352 | A1 | 10/2019 | |
| WO | WO-2019199352 | A1 * | 10/2019 | A63B 1/00 |
| WO | 2021/211825 | A1 | 10/2021 | |

OTHER PUBLICATIONS

Google translation of Chinese cited reference CN107694041A (8 pages).
Google translation of Chinese cited reference CN202506050U (7 pages).
Google translation of Chinese cited reference CN206587342U (5 pages).
First Examination Report dated Sep. 10, 2021, Indian application No. 202017048568 (6 pages).
Google translation of Chinese cited reference CN203886099U (4 pages).
Office Action dated Dec. 21, 2021, Japanese application No. 2021-505179 (2 pages).
English-language translation of Office Action in Japanese application No. 2021-505179, dated Dec. 21, 2021 (3 pages).
Google translation of Russian Patent No. RU2557745 C1 (5 pages).
Google translation of Chinese cited reference CN107297050A (13 pages).
Office Action dated Jan. 13, 2022 in Chinese application No. 201880092314.5 (2 pages).
English-language translation of Office Action dated Jan. 13, 2022 in Chinese application No. 201880092314.5 (5 pages).
Extended European Search Report dated Dec. 22, 2021 in European application No. 18914148.4 (8 pages).
espacenet.com description translation of Japanese cited reference 58-190453 (3 pages).
espacenet.com description translation of Japanese cited reference 62-179478 (3 pages).
Google translation of Japanese cited reference JP2004-520897 (18 pages).
Google translation of Japanese cited reference JP2243170 (7 pages).
Google translation of Japanese cited reference JP2012-110420 (13 pages).
International Search Report for PCT/US2018/057195 (Jan. 4, 2019) (2 Pages).
Written Opinion for PCT/US2018/057195 (Jan. 4, 2019) (3 pages).
Preliminary Rejection dated Apr. 26, 2022 in Korean application No. 10-2020-7032383 (5 pages).
Letter with English-language translation of Preliminary Rejection dated Apr. 26, 2022, in Korean application No. 10-2020-7032383 (5 pages).

(56) References Cited

OTHER PUBLICATIONS

International Search Report for PCT/US2021/027460 dated Jul. 13, 2021 (3 pages).
Written Opinion for PCT/US2021/027460 dated Jul. 13, 2021 (11 pages).
Google translation of Korean cited reference KR 10-1776498 (8 pages).
"Force USA MyRack In-Depth Review", Jul. 18, 2018, Youtube, site visited Dec. 6, 2023:https://www.youtube.com/watch?v=Pz0cDmZF2xs (Year: 2018).
"Force USA MyRack Power Rack Overview", Sep. 25, 2018, Youtube, site visited Jul. 18, 2023: https://www.youtube.com/watch?v= W0aFOzu6TV) (Year: 2018).
"Power Rack Cable Crossover Attachment Preview By Bells of Steel", Apr. 15, 2019, Youtube, site visited Dec. 6, 2023:https://www.youtube.com/watch?v=6EuUpLcBqwA (Year: 2019).
"VANSWE Power Rack" Aug. 6, 2019, Amazon, site visited Jul. 18, 2023: https://www.amazon.com/dp/B088ZL16SB (Year: 2019).
"The Beast Commercial Quality Power Rack with 1500 lbs. Capacity" Jan. 2, 2016, Modern Office Furniture, site visited Jul. 18, 2023: Https://www.modernofficefurniture.com/beast-commercial-power-rack-y13216.html (Year: 2016).
"The Monster Lite Cave" Aug. 2021, Rogue Fitness, site visited Jul. 18, 2023: https://www.roguefitness.com/the-monster-lite-cave (Year: 2021).
"Greatest Garage Gym Tour-2019" Feb. 5, 2019, Youtube, site visited Jul. 21, 2023: gttps://youtube.com/watch?v=a6BknMESy7E (Year: 2019).
"Garage Gym Reviews Gym Tour—COOP" May 28, 2020, Youtube, site visited Jul. 31, 2023: https://www.youtube.come/watch?v=8SMxIRsf4bs (Year: 2020).

* cited by examiner

© 2020 Stacey M. Lewis-Dove

© 2020-2021 Stacey M. Lewis-Dove

© 2020 Stacey M. Lewis-Dove

© 2020 Stacey M. Lewis-Dove

© 2020 Stacey M. Lewis-Dove

© 2020 Stacey M. Lewis-Dove

© 2020 Stacey M. Lewis-Dove

© 2021 Stacey M. Lewis-Dove

© 2020 Stacey M. Lewis-Dove

© 2021 Stacey M. Lewis-Dove

© 2022 Stacey M. Lewis-Dove

© 2022 Stacey M. Lewis-Dove

VERSATILE COMPACT UNIVERSAL GYM WITH DOOR OR DOORS

CROSS-REFERENCE TO RELATED APPLICATIONS

This application claims benefit of priority under 35 U.S.C. § 119(e) of U.S. Provisional Patent Application No. 63/149,305 filed Feb. 14, 2021, and entitled, "Versatile Compact Universal Gym with Door or Doors." The 63/149,305 application is incorporated by reference herein in its entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to configurable versatile exercise equipment with a compact footprint.

BACKGROUND OF THE INVENTION

Versatile gyms, which allow for multiple configurations by which to perform a variety of exercises, are known. However, a problem arises when an exercise enthusiast wants to allow for the wide variety of exercises which can otherwise be found in gyms, but which are too large or unsightly for the majority of interested users to consider for use in the home or office.

A secondary problem arises when limiting the allowable size of exercise equipment, in that certain exercises require a minimum amount of space in which to be correctly and adequately performed. If the size of the available equipment precludes certain desirable exercises, this creates the very problem versatile or universal gyms were meant to solve: eliminating the need for a multiplicity of equipment.

A third problem, which is not limited to exercise equipment, limits the placement of any bulky or unsightly equipment. This third problem is aesthetic. Currently available devices which allow for such storage and deployment do not mimic or conform to the general shape and aesthetic appearance of home or office furniture and therefore discourage users from home or office use.

SUMMARY OF THE INVENTION

Unexpectedly, and building upon decades of experience as a personal trainer, Applicant has invented a compact versatile gym. In some cases, Applicant's universal gym can occupy a remarkably small footprint in a home, office, or gym, and yet provide for a vast array of exercises through a nearly infinite number of possible configurations. In further cases, Applicant's compact versatile gym can further employ attractive and decorative panels that disguise the versatile gym when not in use. That is possible in some cases when the gym includes one or more doors.

Accordingly, some embodiments of the present invention relate to an apparatus for exercising against a resistance, optionally in a confined space, comprising:

a frame, comprising a plurality of vertical members mutually supporting a plurality of horizontal members, wherein the frame has at least a front face joining a side face at a corner;

a door comprising one or more door vertical members mutually supporting one or more door horizontal members, the door being pivotally, slidably, or both pivotally and slidably mounted to the frame in at least one point; wherein the frame and optionally the door provide at least one exercise attachment point.

Further embodiments of the present invention employ a hinge for an apparatus for storage of a variety of tools, comprising:

a frame brace rotatably joined to a door brace by a hinge axle, wherein the frame brace is adapted to slidably engage a track affixed to the frame of the apparatus.

Additional embodiments relate to methods of exercising against a resistance, optionally in a confined space, one such method comprising: Obtaining an apparatus comprising:

a frame, comprising a plurality of vertical members mutually supporting a plurality of horizontal members, wherein the frame has at least a front face joining a side face at a corner;

a door comprising one or more door vertical members mutually supporting one or more door horizontal members, the door being pivotally, slidably, or both pivotally and slidably mounted to the frame in at least one point;

wherein the frame and optionally the door provide at least one exercise attachment point and arranging the apparatus and an assortment of exercise equipment in a variety of positions.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
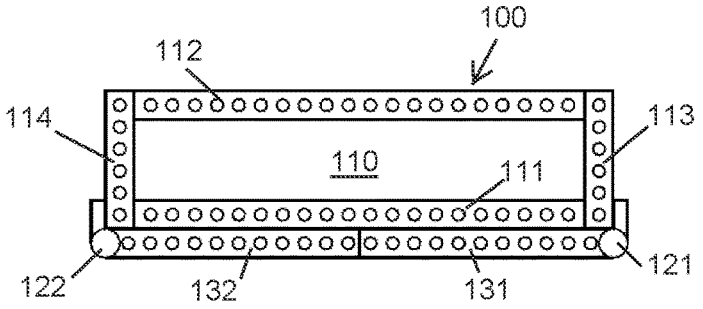
FIG. 1 depicts in a top-down two-dimensional view of one embodiment of the invention in a fully closed position, comprising a front face, a rear face, a left face and a right face, and a left door and a right door.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this disclosure prevail unless stated otherwise.

Wherever the phrase "for example," "such as," "including" and the like are used herein, the phrase "and without limitation" is understood to follow unless explicitly stated otherwise. Similarly, "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

Some embodiments of the present invention relate to an apparatus for exercising against a resistance, optionally in a confined space. As used herein, "exercising against a resistance" indicates movement of the human body or a part thereof against a force such as provided by gravity acting on a mass, friction, elastic deformation, or the like. The mass can be provided by the body of the athlete or a part thereof; or it can be provided by a selected portion of a weight stack or a free weight device such as a barbell, dumbbell, weight plate, kettle ball, or the like. Elastic bands provide resistance as the material of the band responds to, and opposes, an athlete's effort to elastically deform the band. Friction can provide resistance such as, for example, by applying a brake against a reciprocating or rotating device such as a flywheel.

As used herein, a frame defines any rigid structure formed from two or more pieces so as to surround or contain an empty space. The foremost frame face that faces the user is styled the front face. The front face is joined to at least one secondary face styled a side face. The two faces may be joined at any angle such as 90°, so as to form a corner and to give the frame depth. The one or more side faces may also be joined to a rear face. One or more movable barriers in the style of doors is mounted to the frame at one or more corners in which the front and side faces meet in at least one point. The door is joined to the corner at a pivot point allowing for rotational movement around the axis of the pivot point, as well as slidably mounted so as to maintain the same orientation but move about relative to either the front face or side face.

Some embodiments further include a frame with a polygonal shape. As used herein, a polygonal shape is any figure having three or more sides. Typically, but not always, the frame's front face will be distinguishable from the side faces due to its greater length. Further embodiments may include more than three sides. The shape of the frame may be dictated by the space in which the frame is meant to be principally utilized. Therefore, the frame may be triangular, rectangular, pentangular, hexagonal, octagonal, irregularly shaped, etc. As used herein, "horizontal" does not require perfect alignment with the horizon, and "vertical" does not require perfect perpendicularity to the horizon, either. Substantially horizontal and substantially vertical members can be employed. Not by way of limitation, in certain instances, substantially horizontal and substantially vertical can be thought of as including a variation by as much as 20 degrees. In certain cases, the frame members have vertical dimensions and horizontal dimensions and geometries that provide the structural support required. Such a frame can be described as comprising one or more members having one or more vertical portions mutually supporting one or more horizontal portions.

The door affixed to the frame may also take a polygonal shape. The door may take a shape similar to, or different from, the polygonal frame shape. The door shape will typically be chosen so that the door adequately closes against the front face. In some embodiments, the door is of equal height to the frame, and will cover or conceal a portion of the front face at the height of the plurality of front face vertical members when placed in the closed position. In still other embodiments, the door is of equal width to the frame, and will cover or conceal a portion of the front face at the width of the plurality of front face horizontal members when placed in the closed position. In still further embodiments, the door is of less than equal height or width to the frame. In some embodiments, the door can consist of two units horizontally divided in the form of a "Dutch" door. As commonly understood, a "Dutch" door, stable door, half door, or double-hung door is a door divided so that the upper half may open while the lower half remains in place, and vice versa.

Doors are described as having horizontal door members and vertical door members. As used herein, "horizontal" does not require perfect alignment with the horizon, and "vertical" does not require perfect perpendicularity to the horizon, either. Substantially horizontal and substantially vertical members can be employed. Broadly, door members can have any suitable geometry and orientation. In some cases, the door members are horizontal, vertical, or combinations thereof. In further cases, the door members orient at an angle to the horizontal, and may be described as door diagonal members. Not by way of limitation, in certain instances, a diagonal member varies between 20 to 70 degrees from the horizontal. In still further cases, one or more door members can be curved, such as describing part of a circle, an ellipse, or any other desired curving geometry, and may be described as door curved members. A door member may have curving portions and/or straight portions, in any desired combination. Door members need only provide adequate structural support for the mass of the door, any equipment positioned on the door, and any exercise to be conducted from the door where the door provides an exercise attachment point. In some cases, doors may be described as part of the invention that have no formal vertical door members or horizontal door members. In such cases, the door members have vertical dimensions and horizontal dimensions and geometries that provide the structural support required. Such a door can be described as comprising one or more door members having one or more door vertical portions mutually supporting one or more door horizontal portions. Such a door is pivotally and/or slidably mounted to the frame in at least one point.

Doors can be pivotally, slidably, or both pivotally and slidably mounted to the frame in at least one point. A pivotally-mounted door typically rotates about an axis at or near a hinge. A slidably mounted door moves in a single plane or remains parallel to a single plane. When a door can pivot and slide, for example, the door swings open about a hinge to expose the front face of the frame, and then the door slides along the side face of the frame in this example.

At least one track mounted to the front or side face appears in several embodiments. In some cases, an upper track, a lower track, or both an upper track and a lower track appear. As defined herein, an upper track exists where the track is placed in a higher position to a second track, or if only one track exists at or substantially above the midpoint of the frame vertical members. A lower track therefore exists if a track is placed at a lower position to a second track, or if only one track exists at or substantially below the midpoint of the frame vertical members. Where a track appears, one or more doors are joined to the track wherein the doors are adapted to obscure at least a portion of the front face in a closed position; slide along the side face by the upper track and the lower track; assume a plurality of secured open positions; or any combination thereof. In further instances, a track can appear on two faces, such that a door slidably attached to the track slides open exposing the front face of the frame, and then slides along the side face if desired.

The door may be pivotally mounted to the upper track, lower track, or both the upper track and the lower track by a shaft. As used herein, a shaft is understood to include a pin or any device similar to the journal of a plain bearing. A plain bearing, otherwise known as a sliding bearing, slide bearing, solid bearing, journal bearing, or friction bearing, is understood to include a shaft, commonly known as the journal, which contacts the bearing surface on the interior of an outer ring or collar. This pivotal mount can be adjusted to allow the door to have any desired rotational range relative to the front face of the claim, including but not limited to 90°, 120°, 180°, and 270°. The rotational limit of the door is typically determined by the user based on the shape of the frame and the location the apparatus is to be installed.

In some embodiments, the frame or door comprises tubing. As used herein, tubing is understood to be material of any elongated, hollow shape in the form of a tunnel or channel. The tubing may therefore have any cross section, including but not limited to square, triangular, rectangular, cylindrical, conical, hexagonal, or some combination thereof. The frame or door may be constructed of any suitable material, such as, for example, wood, engineered wood, metal, structural polymers such as high-density polyalkanes, polyurethanes, nylons, perfluorinated polyalkanes such as Teflon®, or combinations thereof. Where made of metal, such metal may be chosen from a variety of suitable materials, including but not limited to iron, aluminum, titanium, iron alloys, aluminum alloys, titanium alloys, and combinations thereof.

In addition to allowances for the door to pivot or slide about the front or side faces, some embodiments also incorporate a means for affixing the door in a desired position. Some embodiments include a locking mechanism which allow the door to be locked in a closed position, whereby the door is substantially parallel to and substantially conceals or covers to the front face of the frame. Further embodiments include a doorstop, whereby the door may be affixed in an open position relative to the front face of the frame. As used herein, a doorstop is understood to be any mechanical device whereby fastening, friction, or other method of restricting movement, substantially prevents an object otherwise free to rotate from assuming any other position. Therefore, some embodiments of the current invention include a mechanical doorstop comprising a kick lever with a boot. Still further embodiments include a mechanical doorstop comprising a spring-loaded, foot-operated boot. As used herein, a boot is understood to be any distinct material which may be used as a weight or wedge so as to prevent movement through the imparting of substantial friction or other force. The boot may comprise any suitable material, including but not limited to, wood, rubber, plastic, or any combinations thereof.

Some embodiments include at least one exercise attachment point adjustably affixed to the frame. Other embodiments include at least one exercise attachment point adjustably affixed to the door. As used herein, an exercise attachment point is understood to be any engagement structure for removably and adjustably coupling to a receiving port on the apparatus. Exercise attachments include grips, handles, or other appropriate device for allowing a user to grasp, attached to a device providing resistance. Exercise attachments may also include, but are not limited to, devices such as free weights, dumbbells, barbells, punching heavy bags, or speed bags. In some instances, resistance can be provided from, among other things, retractable cords or elastic cords, or ropes or chains affixed to a point of resistance by way of a pulley or some other routing system. In further instances, resistance can be provided by gravity, such as by acting on the athlete's body, like a chin-up bar, sit-up bench, or treadmill on which the athlete must lift each foot against gravity to take the next step. In still further instances, resistance can be provided by mass, such as the mass of a punching bag.

Some embodiments may incorporate the use of removable decorative panels so as to make the apparatus aesthetically pleasing when placed in an environment such as a home or office where gym equipment would not normally be situated. Decorative panels mounted to the frame or door may allow for the versatile compact gym to take on the appearance of other furniture situated in the space. Decorative panels removably affixed to the frame or doors can also provide a means for concealing the contents of the gym when the doors are in the closed position.

At least one weight stack contained by the frame appears in several embodiments. Some embodiments include at least one weight stack contained by the door. In some cases, the resistance comprises two independent weight stacks contained by the frame, the door, or both. The weight stack contained by the frame or door can appear in any position. For example, in some embodiments, the weight stack is positioned horizontally along the bottom of the frame, substantially centered relative to the front face and the side face.

A weight stack has a number of plates, each of similar or different masses, and a device such as a rod with appropriately-placed holes so that a desired number of plates in the weight stack can be selected for a particular exercise. A pin or key, optionally tipped with a spring-loaded ball bearing, can connect the desired number of plates in the weight stack to the rod. At one end of the rod, a pulley can connect the rod and thereby the desired number of plates in the weight stack to a cable that when pulled, lifts the desired number of plates from the weight stack.

A cable routed about the frame selectively connects the weight stack to an exercise attachment point via one or more pulleys. Generally, the plates of the weight stack will move up and down when an exercise is performed; perfect vertically, however, is not required. The cable with the one or more pulleys translates the up and down motion of the plates from the weight stack into a suitable direction at the exercise attachment point. An exercise attachment point is a place where the cable terminates and allows for the attachment of an exercise engagement device. Any suitable exercise engagement device can be used, such as, for example, a hand grip, an ankle strap, a torso strap, a head strap, a barbell, a dumbbell, or the like, or a multivector extension device as described in PCT/US2018/057195. As used herein, a barbell means a device generally intended for a two-handed grip; a dumbbell is a device generally intended for a one-handed grip. Optionally, a barbell or a dumbbell can receive additional mass in the form of weight plates, and optionally may have one or more elastic band attachment points. Thus, in some cases, a barbell or a dumbbell can engage the weight stack through an exercise attachment point, a floating exercise attachment point (see below), optionally receive one or more weight plates, and optionally engage one or more elastic bands, thereby providing a highly-selective and variable resistance to the athlete. As can be appreciated, weights such as provided by the weight stack or free weight plates, impart a steady resistance, while an elastic band generally provides less resistance when the band is slightly stretched, yet increases resistance as the stretching increases.

An assortment of exercise equipment also appears in several embodiments. Some embodiments include a weighted dumbbell. Some embodiments include a "heavy" punching bag. The scope of the available embodiments is not limited to those examples provided; any exercise devices which can be adjustably affixed about the frame or one or more doors of the apparatus may be used. Other embodiments may include a speed bag, assorted barbells, resistance bands, pull up bars, gymnastic rings, or a leg press. Benches, chairs, yoga mats, or other suitable devices not affixed to the apparatus may also be stored inside the interior space of the frame and utilized as desired by the athlete.

In certain embodiments, a hinge for an apparatus for storage of a variety of tools is included. This hinge comprises a frame brace rotatably joined to a door brace by a hinge axle, wherein the frame brace is adapted to slidably engage a track affixed to the frame of the apparatus. This allows for the door to both pivot rotationally about the axis of the hinge, but also for the door and hinge assembly to slide about the track affixed to the frame. In this way, virtually an infinite number of positional combinations for the frame and door are possible.

Further embodiments incorporating the sliding hinge include a track engagement member. This track engagement member comprises a tubular collar or similar device which is contained within the track. As used herein, a tubular collar may be any exterior cylindrical device, within which a shaft, pin, or other solid cylindrical device is affixed, such that the shaft, pin, or other device allows for rotational movement, and the tubular collar affixed within the track allows for slidable movement of the entire assembly. An example of an engagement member may include, but is not limited to, a plain bearing wherein the bearing surface length exceeds the journal length.

Another hinge embodiment may involve a single rail on which the hinge may slide. In such a hinge, a frame brace is rotatably joined to a door brace by a hinge axle. The frame brace includes a bearing housing guide that engages the rail, allowing the frame brace and thereby the entire hinge to slide along the rail. A door attached to such a hinge therefore can rotate about the hinge axle, and slide along the rail.

The hinge assembly may incorporate a means for limiting movement or locking the assembly into a particular position. For example, some embodiments include a ratchet and latch, the ratchet having ratchet teeth sized to allow an attached component to be set at multiple positions rotationally about the hinge axle. The ratchet teeth may be sized for any incremental change in position, including but not limited to increments of 15°, 30°, 45°, 54°, 90°, or 180°. Freedom of rotation is limited from 0° (where the door is substantially parallel to the front face of the frame) to 270° (where the door is substantially parallel to the side face of the frame to which corner the door is affixed). The hinge may also incorporate a hydraulic operator (such as a hydraulic cylinder and piston assembly), wherein the door is either hydraulically assisted to open or to shut or both open and shut. In some instances the rotation of the door brace about the hinge axle may be restricted by means of friction, or a mechanical stop may be incorporated such that, beyond a certain point in the door's rotation about the hinge, rotation about the hinge axle ceases and the movement of the door becomes dependent on the movement of the piston within the hydraulic operator.

Methods of exercising against a resistance, optionally in a confined space, also exist in some embodiments of the current invention. Such methods include obtaining an apparatus comprising a frame that comprises a plurality of vertical members mutually supporting a plurality of horizontal members, wherein the frame has at least a front face joining a side face at a corner; one or more doors comprising one or more door vertical members mutually supported by one or more door horizontal members, the door being pivotally and slidably mounted to the frame in at least one point; wherein the frame and optionally the door provide at least one exercise attachment point.

Other methods for exercising against a resistance, optionally in a confined space, include obtaining an apparatus incorporating the slidable hinge as described above. Further embodiments include methods of employing a variety of exercise equipment, whereby such equipment can be adjustably positioned in a variety of positions, allowing for a functionally equivalent exercise which may be performed with substantially the same utility, where the door is arranged in any of multiple possible positions.

As used herein, a confined space indicates something less than a wide-open gym. A confined space can be indicated by an apparatus having a small footprint, such as, for example, one horizontal dimension no greater than about 1 foot, no greater than about 2 feet, no greater than about 3 feet, no greater than about 4 feet, no greater than about 5 feet, no greater than about 6 feet, no greater than about 7 feet, no greater than about 8 feet, no greater than about 10 feet, no greater than about 11 feet, or no greater than about 12 feet. In other cases, a confined space can be indicated by an apparatus having no horizontal dimension greater than about 1 foot, no greater than about 2 feet, no greater than about 3 feet, no greater than about 4 feet, no greater than about 5 feet, no greater than about 6 feet, no greater than about 7 feet, no greater than about 8 feet, no greater than about 10 feet, no greater than about 11 feet, or no greater than about 12 feet. Applicant's apparatuses are not limited, however. In some cases, an apparatus has at least one horizontal dimension greater than about 12 feet. In other cases, there is no horizontal dimension less than about 12 feet.

DETAILED DESCRIPTION OF THE DRAWINGS

Further embodiments of the present invention can be described by reference to the accompanying drawings.

FIG. 1 depicts a two-dimensional perspective as seen from overhead of one embodiment of the invention, apparatus 100. Apparatus 100 has a frame comprising a plurality of vertical members (not seen) and horizontal members including top front horizontal member 111, top rear horizontal member 112, top right face horizontal member 113, and top left face horizontal member 114, which collectively form top face 110. Additional vertical members and/or horizontal members can be added as desired. Affixed to the right hinge 121 is a right door 131 in a fully closed position relative to the front face and top front horizontal member 111. Affixed to the left hinge 122 is a left door 132 in a fully closed position relative to the front face and top front horizontal member 111. The right door 131 and the left door 132 may meet at a position approximately midpoint between the outermost points of the horizontal member of the top front horizontal member 111, as shown in this figure.

Figure 2:
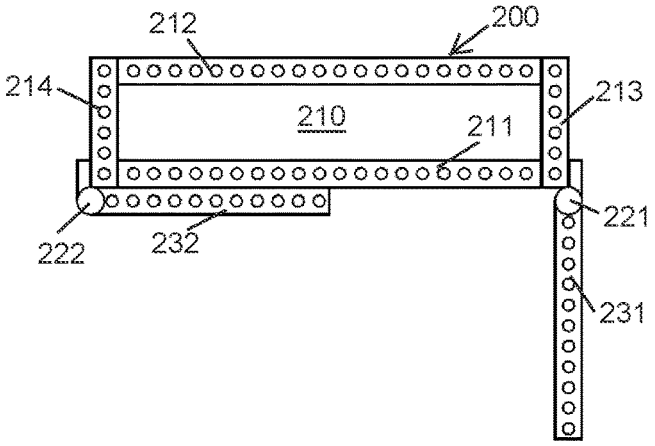
FIG. 2 depicts in a top-down two-dimensional view of another embodiment of the invention comprising a front face, a rear face, a left face and a right face, and a left door and a right door, wherein the right door is opened to 90° relative to the front face.

FIG. 2 depicts a two-dimensional perspective as seen from overhead of one embodiment of the invention, apparatus 200. Apparatus 200 has a frame comprising a plurality of vertical members (not seen) and horizontal members including top front horizontal member 211, top rear horizontal member 212, top right face horizontal member 213, and top left face horizontal member 214, which collectively form top face 210. Additional vertical members and/or horizontal members can be added as desired. Affixed to the right hinge 221 is a right door 231 in a 90° open position relative to the front face and top front horizontal member 211. Affixed to the left hinge 222 is a left door 232 in a fully closed position relative to the front face and top front horizontal member 211.

Figure 3:
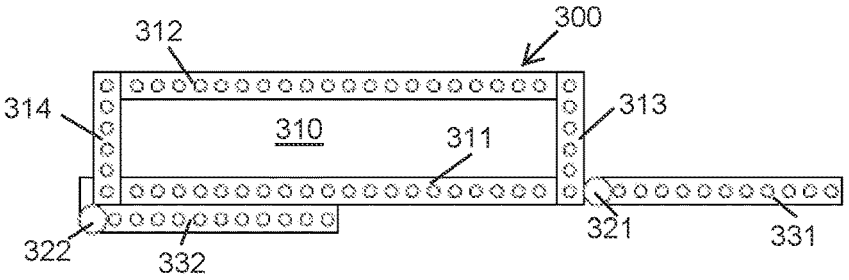
FIG. 3 depicts in a top-down two-dimensional view of another embodiment of the invention comprising a front face, a rear face, a left face and a right face, and a left door and a right door, wherein the right door is opened to 180° relative to the front face.

FIG. 3 depicts a two-dimensional perspective as seen from overhead of top one embodiment of the invention, apparatus 300. Apparatus 300 has a frame comprising a plurality of vertical members (not seen) and horizontal members including top front horizontal member 311, top rear horizontal member 312, top right face horizontal member 313, and top left face horizontal member 314, which collectively form top face 310. Additional vertical members and/or horizontal members can be added as desired. Hinges 321, 322 are attached to the horizontal member of the frame relative to the uppermost position of the left and right vertical members (not seen) where the vertical members meet the horizontal members of the top front horizontal member 311, top right face horizontal member 313, and top left face horizontal member 314. Affixed to each hinge is a door. Affixed to the right hinge 321 is a right door 331 in a 180° open position relative to the front face 311. The right door 331 is shown in its forwardmost position along top right face horizontal member 313. Affixed to the left hinge 322 is a left door 332 in a fully closed position relative to the front face and top front horizontal member 311.

Figure 4:
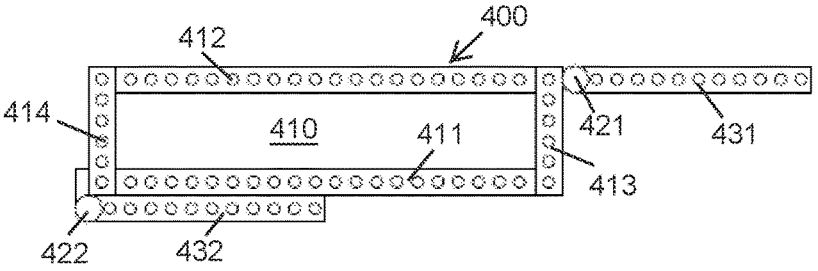
FIG. 4 depicts in a top-down two-dimensional view of another embodiment of the invention comprising a front face, a rear face, a left face and a right face, and a left door and a right door, wherein the right door is opened to 180° relative to the front face, and the door is positioned at its rear-most position along the track.

FIG. 4 depicts a two-dimensional perspective as seen from overhead of top one embodiment of the invention, apparatus 400. Apparatus 400 has a frame comprising a plurality of vertical members (not seen) and horizontal members including top front horizontal member 411, top rear horizontal member 412, top right face horizontal member 413, and top left face horizontal member 414, which collectively form top face 410. Additional vertical members and/or horizontal members can be added as desired. Hinges 421, 422 are attached to the horizontal member of the frame relative to the uppermost position of the left and right vertical members (not seen) where the vertical members meet the top front horizontal member 411, top right face horizontal member 413, and top left face horizontal member 414. Affixed to each hinge is a door. Affixed to the right hinge 421 is a right door 431 in a 180° open position relative to the front face and top front horizontal member 411. The right door 431 is shown at positioned at its rear most position along top right face horizontal member 413. Affixed to the left hinge 422 is a left door 432 in a fully closed position relative to the front face and top front horizontal member 411.

Figure 5:
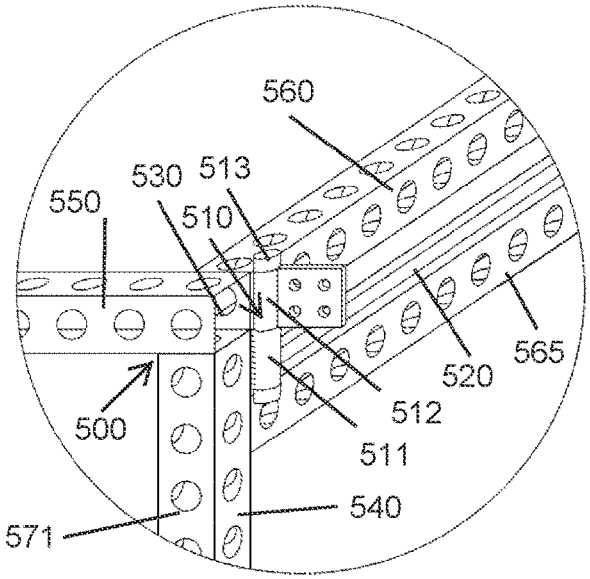
FIG. 5 depicts an embodiment of a hinge as seen set in a track of the frame positioned near a corner of a frame.

FIG. 5 depicts close up perspective view of an embodiment of slidably adjustable hinge 510 as seen set in a track 520 of the frame 500 in a position adjacent to a corner 530 which is defined by the meeting of a vertical member 540 and two horizontal members, 550 and 560, respectively. The track 520 is defined by horizontal frame member 560 and a second horizontal member 565 set at a slightly lower position relative to the vertical frame member 540. The hinge 510 is affixed to the frame 500 in the track 520 by a frame brace 511 (partially obscured). Frame brace 511 is rotatably joined to door brace 512 by hinge axle 513. Door brace 512 can affix a door (not shown). Thus, in some embodiments, one or more simple hinges such as hinge 510 can slidably and rotationally join a door to the frame of the apparatus. This also can be described as a door being pivotally and slidably mounted to the frame in at least one point. Vertical member 540 is made of square tubing, and includes holes that can function as accessory receiving port 571, for example.

Figure 6:
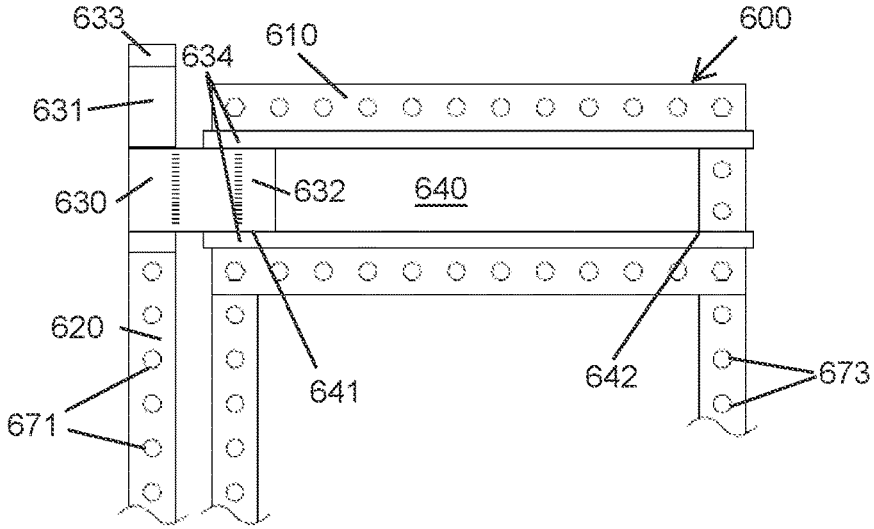
FIG. 6 depicts an embodiment of a hinge as set within a track positioned on the frame of the apparatus, where the door is able to rotate about the hinge, and the hinge is able to travel the span of the track.

FIG. 6 depicts a two-dimensional perspective of apparatus 600 wherein the hinge 630 is set within a track 640 as positioned on frame 610. The hinge 630 comprises frame brace 632 rotatably joined to a door brace 631 by a hinge axle 633, wherein the frame brace 632 is adapted to slidably engage track 640 affixed to frame 610 of the apparatus. Frame brace 632 is adapted to slidingly engage track 640 within track guides 634, the frame brace 632 engaging the track 640 in a manner similar to that shown in FIG. 8. Door 620 comprises door accessory receiving ports 671. Frame 610 comprises accessory receiving ports 673. Door accessory receiving ports 671 and accessory receiving ports 673 provide anchor points for exercise attachment points such as pulleys providing a cable terminus and carabiner (not shown). Door 620 is able to freely rotate about the hinge's 630 hinge axle 633 while also able to traverse the forwardmost 641 and rearmost 642 limits of the length of the track 640. This can be described as door 620 being pivotally and slidably mounted to frame 610 in at least one point.

Figure 7:
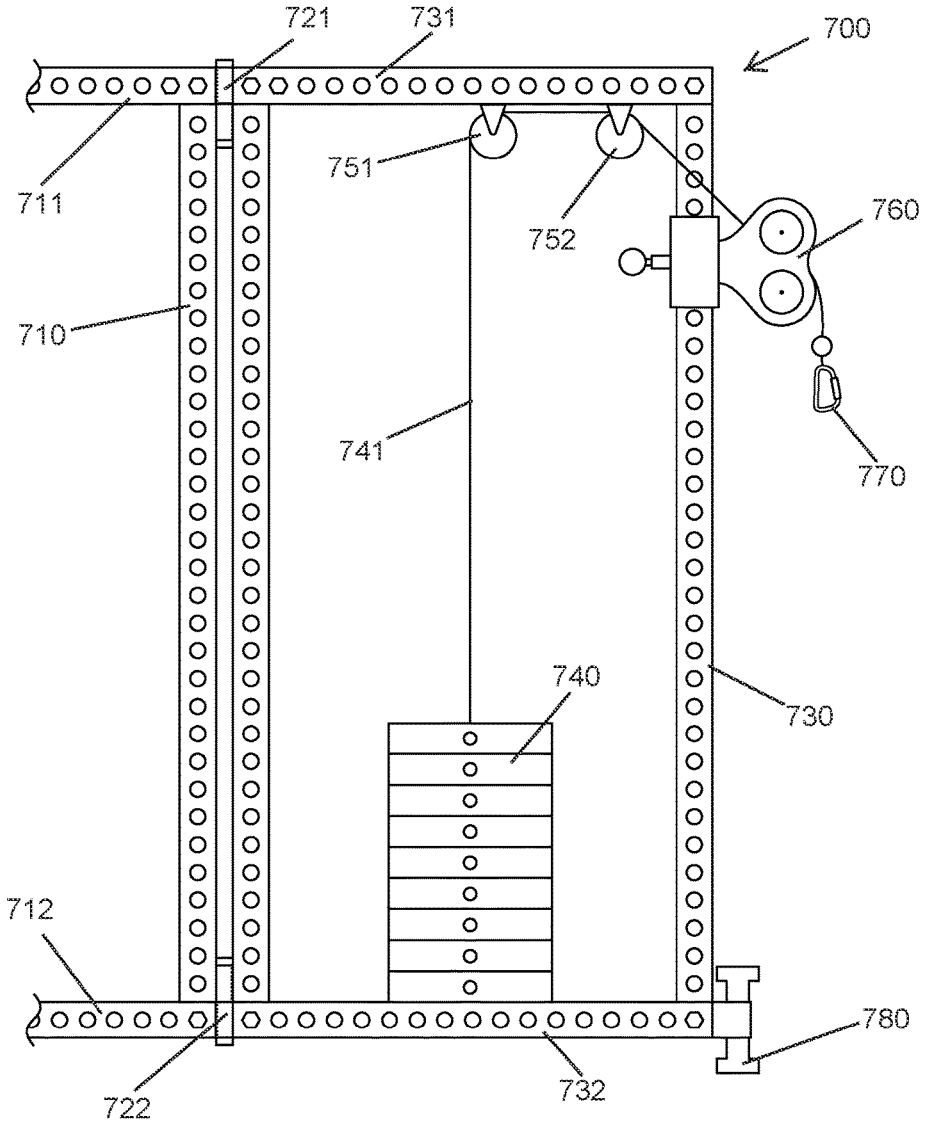
FIG. 7 depicts an embodiment of a door as affixed to the frame with an upper and lower hinge, arranged in an open position, and containing a weight stack, various pulleys, and an adjustably affixed exercise attachment point.

FIG. 7 depicts an embodiment of apparatus 700 wherein a door 730 is affixed to the frame 710 with an upper hinge 721 and lower hinge 722. Thus, door 730 is affixed to frame 710 at two points. The door 730 is shown in a 180° open position relative to the frame 710, such that the upper door horizontal member 731 and lower door horizontal member 732 of the door 730 are substantially parallel with the upper horizontal member 711 and lower horizontal member 712 of the frame 710. The door 730 contains a weight stack 740, connected to an adjustably positioned door exercise attachment point 760 with cable 741. The weight stack 740 is affixed to the adjustably positioned door exercise attachment point 760 by routing the cable 741 about a variety of pulleys 751 and 752, wherein further devices such as, but not limited to, a gripping device (not shown) may be attached through an ancillary device such as a carabiner 770 or other suitable device. Door 730 is also shown with a mechanical doorstop 780.

Figure 8:
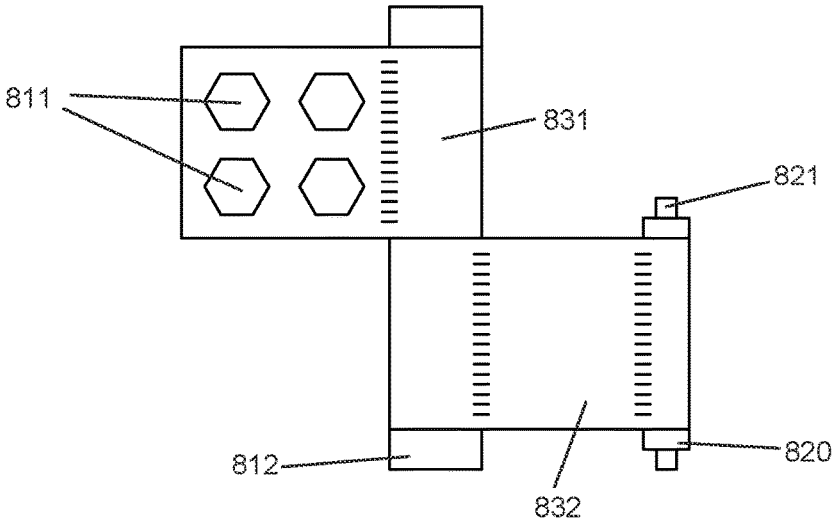
FIG. 8 depicts an embodiment of a slidably adjustable hinge, seen without the accompanying door, where the hinge may be installed in and positioned so as to be able to travel along the span of the track.

FIG. 8 depicts a two-dimensional representation of an embodiment of a hinge 800. Hinge 800 comprises frame brace 832 rotatably joined to door brace 831 by hinge axle 812. Frame brace 832 is adapted to slidably engage a track (not shown) affixed to a frame (also not shown) of an apparatus with track engagement member 820, which comprises a tubular collar consisting of a shaft 821 or other suitable engagement device that can be contained within the track. Door brace 831 is adapted to be rigidly affixed to a door (not shown) with a series of connection points 811.

Figure 9:
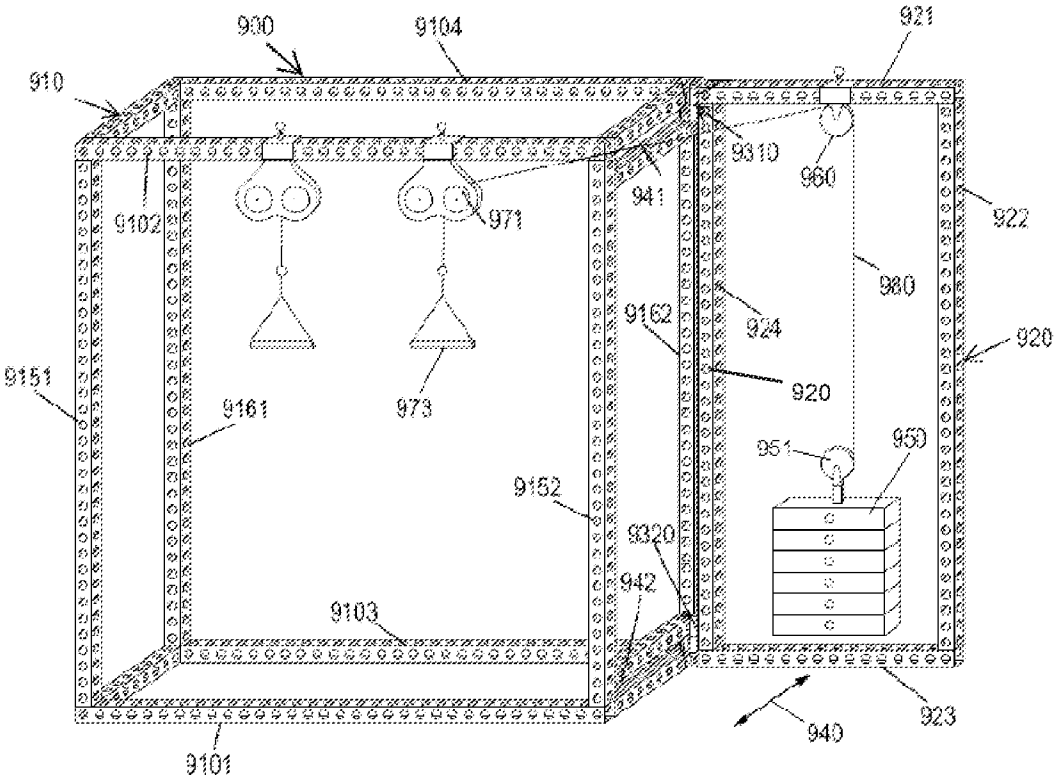
FIG. 9 depicts an axonometric projection of an embodiment of the invention with a right door open to 180° relative to the front face, positioned along the span of an upper track and a lower track in the door's rear-most position, and with a directional indicator providing for the direction of travel of the door along the tracks.

FIG. 9 depicts an axonometric projection of an embodiment of the invention, apparatus 900 with a door 920 open 180° relative to the front face defined by left vertical member 9151, right vertical member 9152, lower horizontal member 9101 and upper horizontal member 9102, positioned along the span of the upper track 941 and the lower track 942 in its rear-most position, substantially parallel to the rear face defined by left vertical member 9161, right vertical member 9162, lower horizontal member 9103, and upper horizontal member 9104 of the frame 910. The door 920 is comprised of upper door horizontal member 921, lower door horizontal member 923, right vertical door member 922, and left vertical door member 924. The door 920 is affixed to the frame 910 with upper hinge 9310 and lower hinge 9320, located proximal to the point where the upper door horizontal member 921 and lower door horizontal member 923 meet the left vertical door member 924, respectively. The upper hinge 9310 is affixed to allow travel through the span of the upper track 941, and the lower hinge 9320 is affixed to allow travel through the span of the lower track 942. Arrow 940 indicates the range of slidable motion of door 920. The door 920 is thus able to rotate about upper hinge 9310 and lower hinge 9320 and slide back and forth along upper track 941 and lower track 942. A weight stack 950 is shown in the door 920 affixed to an adjustably positioned exercise attachment point 971 installed along the upper horizontal member 9102 with a cable 980 via a first pulley 951 affixed to the wight stack and a second pulley 960 adjustably affixed to the upper door horizontal member 921. An additional pully (not shown) may be provided to ensure adequate routing of the cable 980 to prevent fouling as the door 920 is repositioned. The adjustable resistance is provided by altering the number of plates selected in the weight stack 950, varying the rotational position of the door 920 about the upper hinge 9310 and lower hinge 9320, varying the door 920 position relative to the front face of the frame 910 by sliding along the upper track 941 and lower track 942, and by adjustably positioning the exercise attachment point 971.

Figure 10:
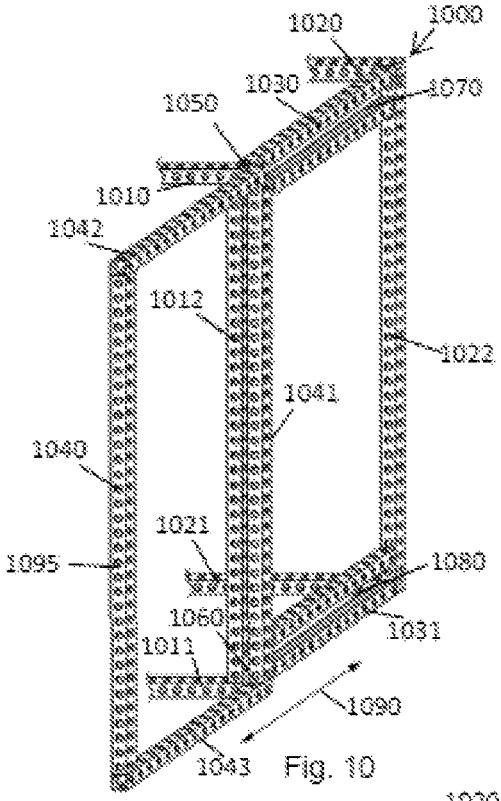
FIGS. 10-13 depict partial axonometric projections of an embodiment of the invention with a door open at various angles and moved to various positions.

FIG. 10 depicts a partial axonometric projection of an embodiment of the invention apparatus 1000 with a door 1095 open to about 90° about the upper hinge 1050 (partially obscured) and lower hinge 1060 relative to the front face. The front face is defined in part by upper front horizontal member 1010, lower front horizontal member 1011, and right front vertical member 1012. The rear face is defined by rear upper horizontal member 1020, rear lower horizontal member 1021, and rear right vertical member 1022. The right face is defined by right front vertical member 1012, right rear vertical member 1022, right upper horizontal member 1030, and right lower horizontal member 1031. The door is defined by door left vertical member 1040, door right vertical member 1041, door upper horizontal member 1042, and door lower horizontal member 1043. The door 1095 is positioned along the span of the upper track 1070 and lower track 1080 in its forward-most position along the available range of travel relative to the forward face and rear face, along the span of the upper track 1070 and lower track 1080. A directional arrow 1090 is provided to indicate the direction of travel of the door 1095 along the upper track 1070 and lower track 1080.

Figure 11:
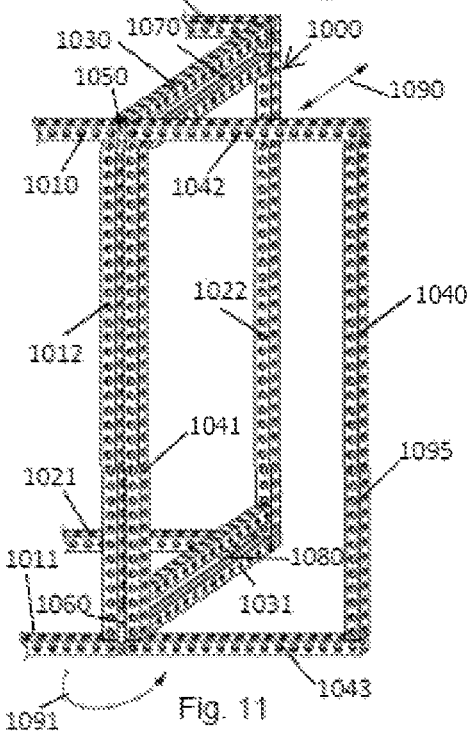
Figure 12:
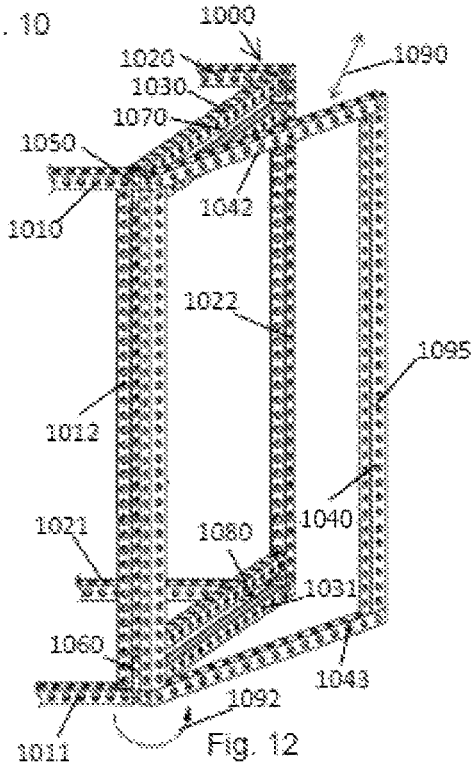
Figure 13:
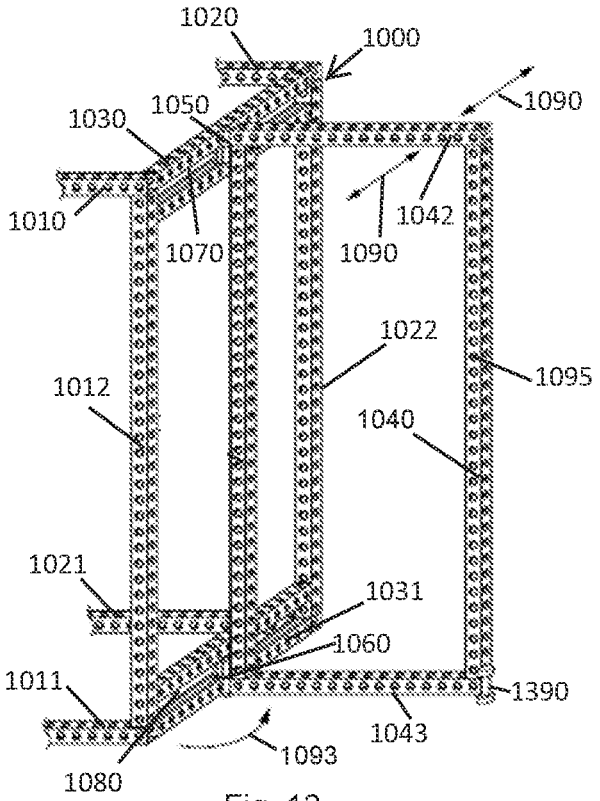

FIG. 11 shows apparatus 1000 with door 1095 open to 180° relative to the front face of apparatus 1000, and in its forward-most position along the available range of travel along the span of the upper track 1070 and lower track 1080. FIG. 12 shows apparatus 1000 with door 1095 open to more than to 180° relative to the front face of apparatus 1000. Door 1095 remains in its forward-most position along upper track 1070 and lower track 1080. FIG. 13 shows door 1095 of apparatus 1000 open to 180° relative to the front face of apparatus 1000, but positioned approximately midway back along upper track 1070 and lower track 1080. In FIG. 13, mechanical doorstop 1390 has been attached to right door vertical member 1041. In each of FIGS. 11-13, arrows 1091, 1092, 1093 depict at least some of the angular range of motion of the door 1095.

Figure 14:
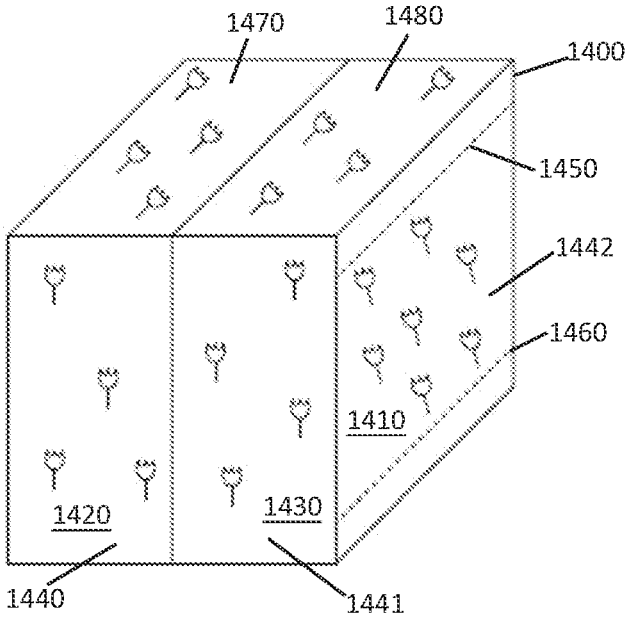
FIG. 14 depicts an axonometric projection of an embodiment of the invention incorporating decorative panels.

FIG. 14 depicts an axonometric projection of apparatus 1400. Left door 1420 includes left door decorative panel 1440. Right door 1430 includes a right door decorative panel 1441. Over the right face 1410, a right face decorative panel 1442 is affixed. Dotted lines 1450, 1460 show the relative positions of an upper track and a lower track, respectively. Top left panel 1470 and top right panel 1480 cover apparatus 1400.

Figure 15:
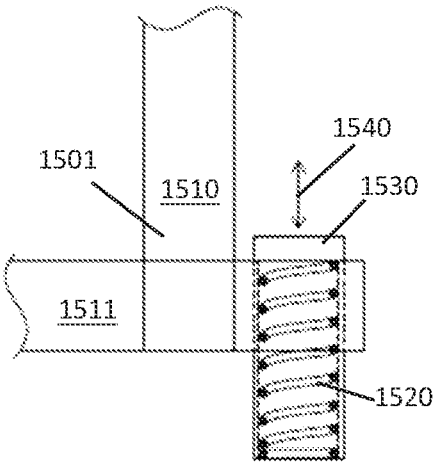
FIG. 15 depicts a cutaway view of the bottom outer corner of a door incorporating a spring-loaded foot-operated boot, with a directional arrow indicating the motion of the boot.

FIG. 15 depicts an exaggerated cutaway view of the bottom outer corner of a partial view of a door 1501 comprising a door vertical member 1510 and door horizontal member 1511. Door 1501 incorporates a spring-loaded foot-operated boot 1530 including spring 1520 which operates to maintain the door 1501 in a fixed position when boot 1530 is deployed. A directional arrow 1540 indicating the range of motion of the boot 1530.

Figure 16:
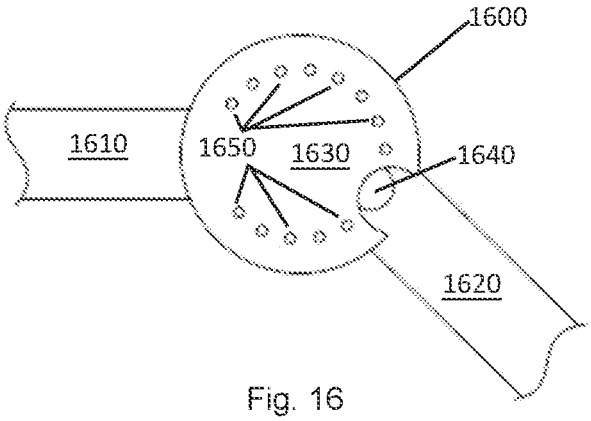
FIG. 16 depicts top plan view of an example of a hinge attached to a frame member and a door member which incorporates a ratchet and latch system for providing a series of fixed hinge positions.

FIG. 16 depicts a top plan view of an example of a hinge 1600 attached to a partially-shown frame member 1610 and a partially shown door member 1620. Hinge 1600 incorporates a ratchet 1630 and latch 1640 for providing a collective series of fixed positions 1650 about which the latch 1640 can lock, allowing the door to be fixed in position at predetermined angular positions.

Figure 17:
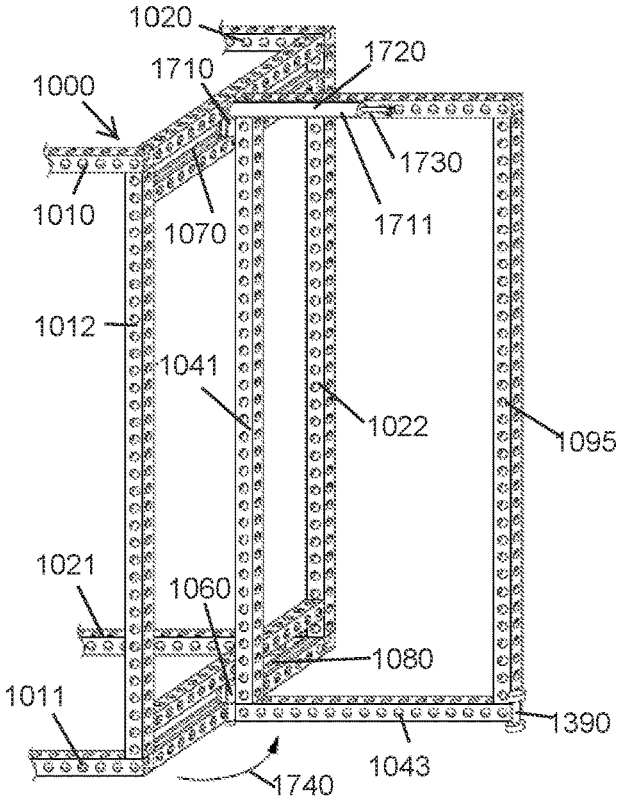
FIGS. 17-18 depict a partial view of the apparatus with an example of a hinge incorporating a hydraulically assisted operator incorporating a cylinder and piston, adapted to assist in positioning of a door, slidably affixed along a track of the apparatus, with the hinge rigidly affixed to a corner of a door, and with a directional arrow indicating the rotational range of motion of the hinge against the assistance of the hydraulic operator.

FIG. 17 depicts apparatus 1000 further incorporating a hydraulically assisted operator 1711 on upper hinge 1710 incorporating a hydraulic cylinder 1720 rigidly affixed to a door brace (obscured) of upper hinge 1710 and a piston 1730 rigidly affixed to a door 1095. The hydraulic cylinder 1720 and piston 1730 are affixed in this embodiment to assist in operation of the door 1095, assisting the operator in rotating the door about the hydraulically assisted upper hinge 1710 in a clockwise direction. Mechanical doorstop 1390 in this embodiment is utilized to provide resistance against the hydraulic cylinder 1720 and piston 1730 assembly to prevent the door from inadvertent movement. Curved directional arrow 1740 is provided, indicating the range of motion of the door 1095 against the hydraulic cylinder 1720 and piston 1730 in the door's 1095 open direction relative to the front face.

Figure 18:
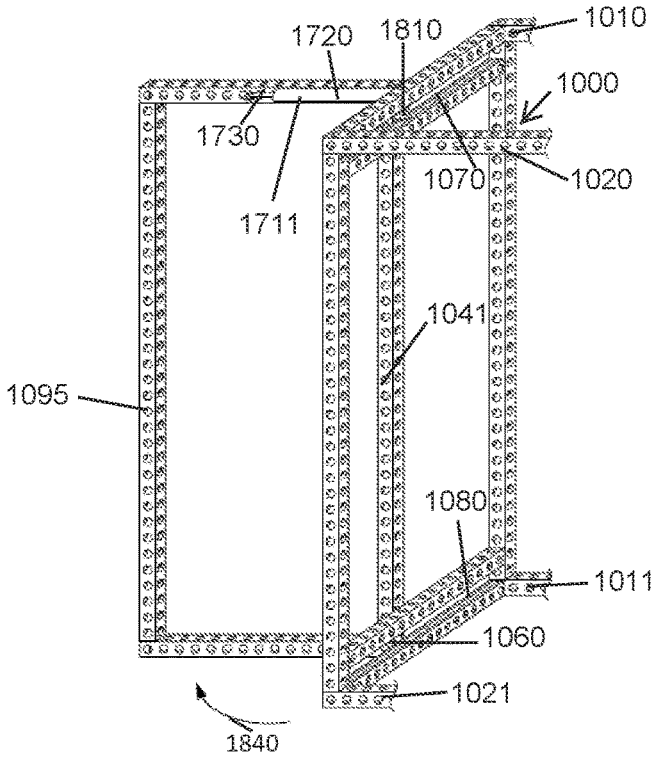

FIG. 18 depicts apparatus 1000 further incorporating a hydraulically assisted operator 1711 on upper hinge 1810 (partially obscured) incorporating a hydraulic cylinder 1720 (partially obscured) rigidly affixed to a door brace (not shown) and a piston 1730 rigidly affixed to a door 1095. The hydraulic cylinder 1720 and piston 1730 are affixed in this embodiment to assist in counterclockwise operation of the door 1840, assisting the operator in rotating the door about the hydraulically assisted upper hinge 1810 in a counterclockwise direction. Curved directional arrow 1840 is provided, indicating the range of motion of the door 1095 against the hydraulic cylinder 1720 and piston 1730 in the door's 1095 open direction relative to the front face.

Figure 19:
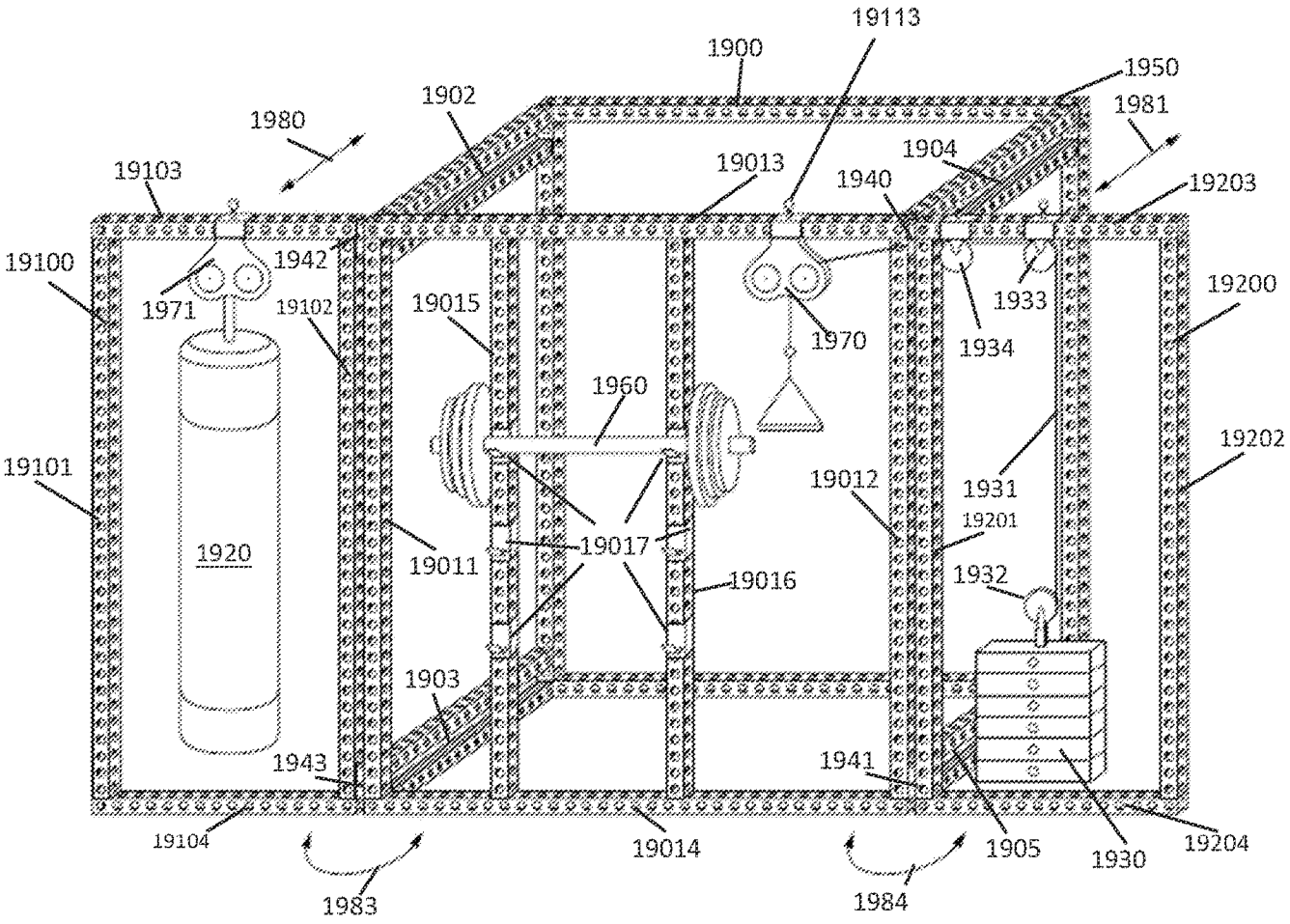
FIG. 19 depicts an axonometric projection of an embodiment of the invention with the right door and left door open to 180° relative to the front face, positioned along the span of the tracks in its forward-most position, with a directional indicator providing for the direction of travel of the door along the tracks, and with the apparatus incorporating a variety of configurable exercise implements.

FIG. 19 depicts an axonometric projection of an embodiment of the invention, apparatus 1900 which includes a left door 19100 defined by left door left vertical member 19101, left door right vertical member 19102, left door upper horizontal member 19103, and left door lower horizontal member 19104; and a right door 19200 defined by right door left vertical member 19201, right door right vertical member 19202, right door upper horizontal member 19203, and right door lower horizontal member 19204. The left door 19100 and right door 19200 appear open to 180° relative to the front face, defined by front face left vertical member 19011, front face right vertical member 19012, front face upper horizontal member 19013, and front face lower horizontal member 19014. The left door 19100 is positioned along the span of the upper left track 1902 and lower left track 1903 in its forward-most position relative to the front face. The right door 19200 is positioned along the span of the upper right track 1904 and lower right track 1905 in its forward-most position relative to the front face. A left door directional indicator 1980 and right door directional indicator 1981 indicate the range of motion of the left door 19100 and right door 19200, respectively. A curved left door directional indicator 1983 and curved right door directional indicator 1984 indicate portions of the range of angular motion of the left door 19100 and right door 19200, respectively. A heavy bag 1920 is shown affixed to an adjustably positioned door exercise attachment point 1971 affixed to the upper horizontal left door member 19103. A weight stack 1930 is shown in the right door 19200 affixed to an adjustably positioned exercise attachment point 1970 (installed along the front face upper horizontal member 19013) with a cable 1931 via a pulley 1932 affixed above the weight stack 1930 and a pulley 1933 adjustably fixed to the upper horizontal right door member 19203. Pin 19113 inserted into a receiving port along front face upper horizontal member 19013 removably and adjustably couples exercise attachment point 1970 to front face upper horizontal member 19013. An additional pully 1934 is provided affixed to upper horizontal right door member 19203 to ensure adequate routing of the cable 1931 to prevent fouling as the right door 19200 is rotated about the upper right hinge 1940 and lower right hinge 1941 or repositioned along the upper right track 1904 and lower right track 1905. The adjustable resistance is provided by altering the number of plates selected in the weight stack 1930, varying the rotational position of the right door 19200 about the upper right hinge 1940 and lower right hinge 1941; varying the right door 19200 position relative to the front face of the frame 1950 by sliding along the upper right track 1904 and lower right track 1905, and/or by adjustably positioning the exercise attachment point 1970. Also shown is an adjustably positioned left front face vertical guide member 19015 and a right front face vertical guide member 19016 with a variety of adjustably positioned support positions (collectively, 19017) that hold barbell 1960.

Figure 20:
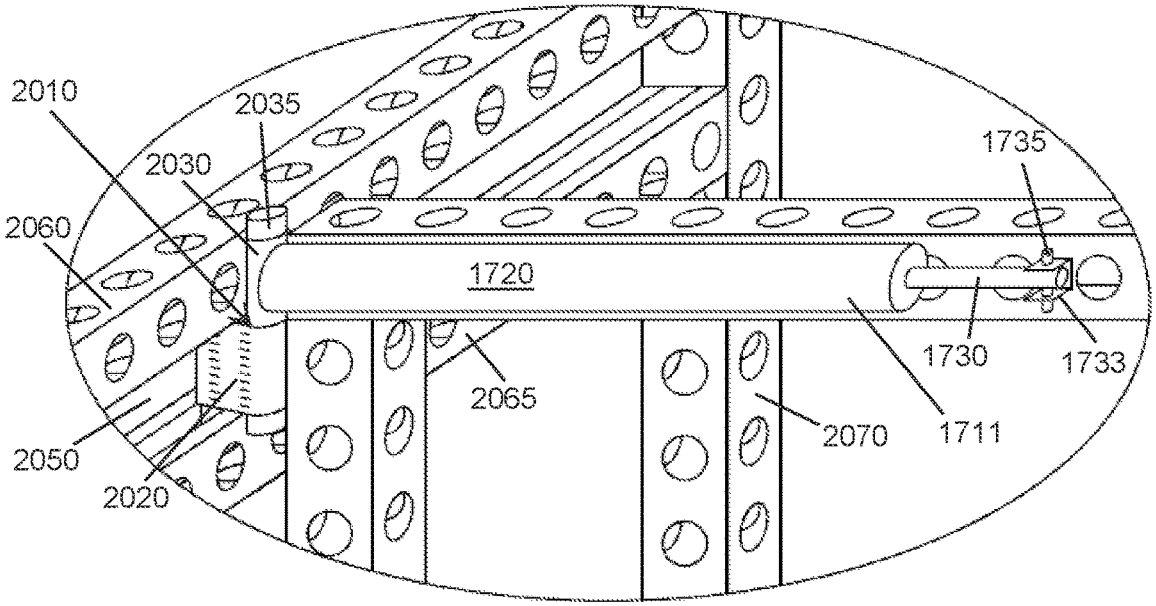
FIG. 20 depicts a close-up perspective view of an embodiment of a hydraulically assisted operator, comprising a hydraulic cylinder and piston; the hydraulic cylinder rigidly affixed to a hinge which is slidably affixed to the frame within a track; and the piston rigidly affixed to a door with a pin and bracket.

FIG. 20 depicts a close up perspective view of an example of hydraulically assisted operator 1711 and hinge 2010, comprising a door brace 2030 and frame brace 2020. Hydraulically assisted operator 1711 includes hydraulic cylinder 1720 rigidly affixed to the door brace 2030; the door brace 2030 rotationally affixed about a hinge axle 2035. The hydraulic cylinder 1720 contains a piston 1730 that is rigidly affixed to the door with a door bracket 1733 and pin 1735. In some embodiments the door brace 2030 may have its rotation limited by friction or by a mechanical stop, thus allowing the hydraulic cylinder 1720 and piston 1730 to assist in positioning the door. The frame brace 2020 is slidably affixed within a track 2050 (partially obscured) which is defined by an upper horizontal frame member 2060 and a second horizontal member 2065 (partially obscured) set in a position lower than the upper horizontal frame member 2060 as referenced from an adjoining vertical frame member 2070 (partially obscured).

Figure 21:
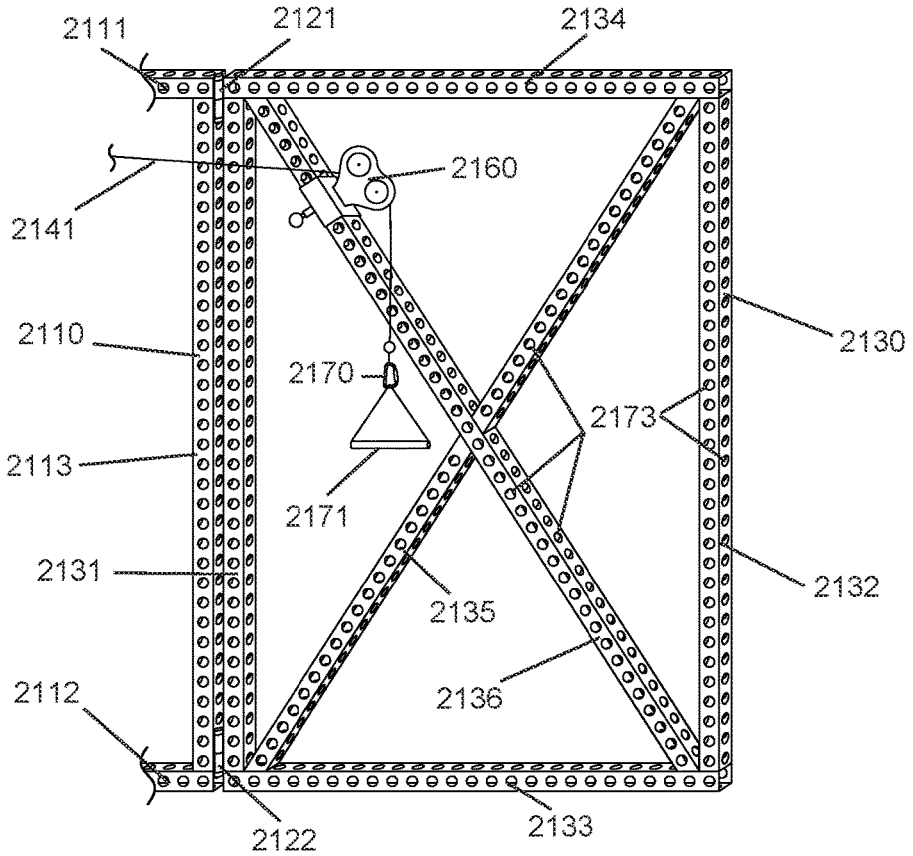
FIG. 21 depicts an embodiment of a door as affixed to the frame with an upper and lower hinge, arranged in an open position, and having diagonal door members.

FIG. 21 depicts an embodiment of a door as affixed to the frame with an upper and lower hinge, arranged in an open position, and having diagonal door members. Door 2130 is rotatably affixed to frame 2110 with an upper hinge 2121 and lower hinge 2122. Thus, door 2130 is pivotally affixed to frame 2110 at two points. The door 2130 is shown in a 180° open position relative to the frame 2110, such that the upper door horizontal member 2134 and lower door horizontal member 2133 of the door 2130 are substantially parallel with the upper horizontal member 2111 and lower horizontal member 2112 of the frame 2110. The door 2130 contains door exercise attachment point 2160 that routes cable 2141 to gripping device 2171 attached through carabiner 2170. Cable 2141 can access a weight stack (not shown) positioned elsewhere in frame 2110. Frame 2110 also includes vertical member 2113 supporting upper horizontal member 2111 and lower horizontal member 2112. Door 2130 further includes door vertical members 2131, 2132, and door diagonal members 2135, 2136 in addition to door horizontal members 2133, 2134, all mutually supporting each other. Numerous door accessory receiving ports 2173 can be seen all over door 2130.

Figure 22:
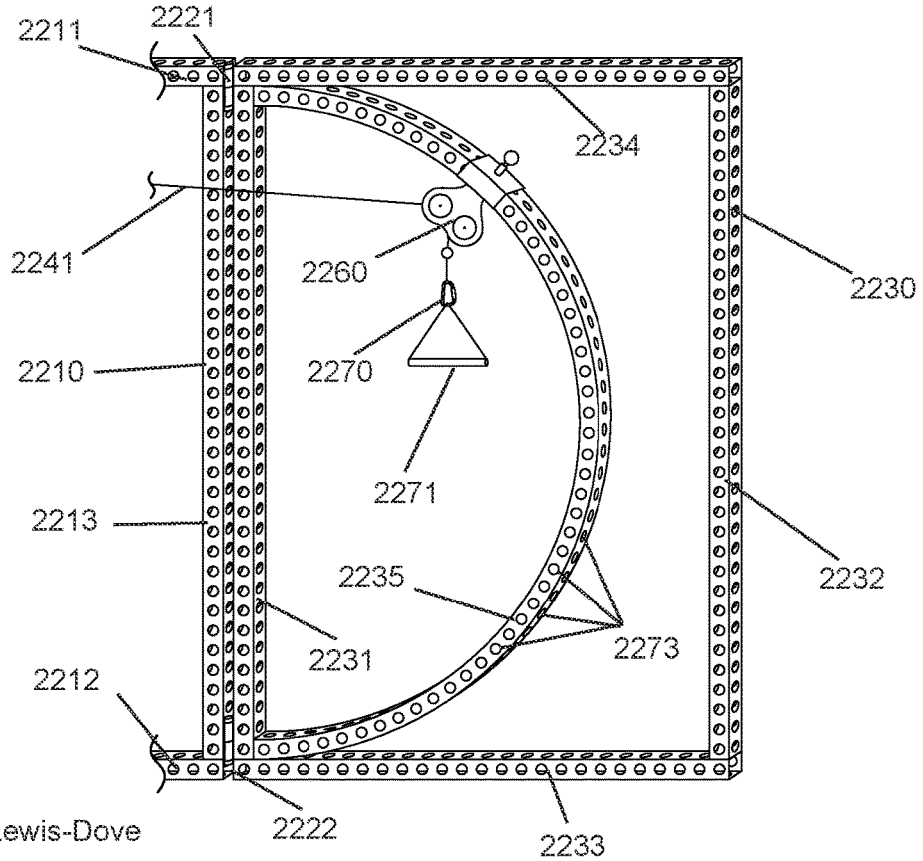
FIG. 22 depicts an embodiment of a door as affixed to the frame with an upper and lower hinge, arranged in an open position, and having a curved door member.

FIG. 22 depicts an embodiment of a door as affixed to the frame with an upper and lower hinge, arranged in an open position, and having a curved door member. Door 2230 is rotatably affixed to frame 2210 with an upper hinge 2221 and lower hinge 2222. Thus, door 2230 is pivotally affixed to frame 2210 at two points. The door 2230 is shown in a 180° open position relative to the frame 2210, such that the upper door horizontal member 2234 and lower door horizontal member 2233 of the door 2230 are substantially parallel with the upper horizontal member 2211 and lower horizontal member 2212 of the frame 2210. The door 2230 contains door exercise attachment point 2260 that routes cable 2241 to gripping device 2271 attached through carabiner 2270. Cable 2241 can access a weight stack (not shown) positioned elsewhere in frame 2210. Frame 2210 also includes vertical member 2213 supporting upper horizontal member 2211 and lower horizontal member 2212. Door 2230 further includes door vertical members 2231, 2232, and door curved member 2235 in addition to door horizontal members 2233, 2234, all mutually supporting each other. It is possible that an athlete standing before frame 2210 can position door exercise attachment point 2260 at any place along door curved member 2235 using door accessory receiving ports 2273 to enjoy a broad range of abduction and extension exercises.

Figure 23:
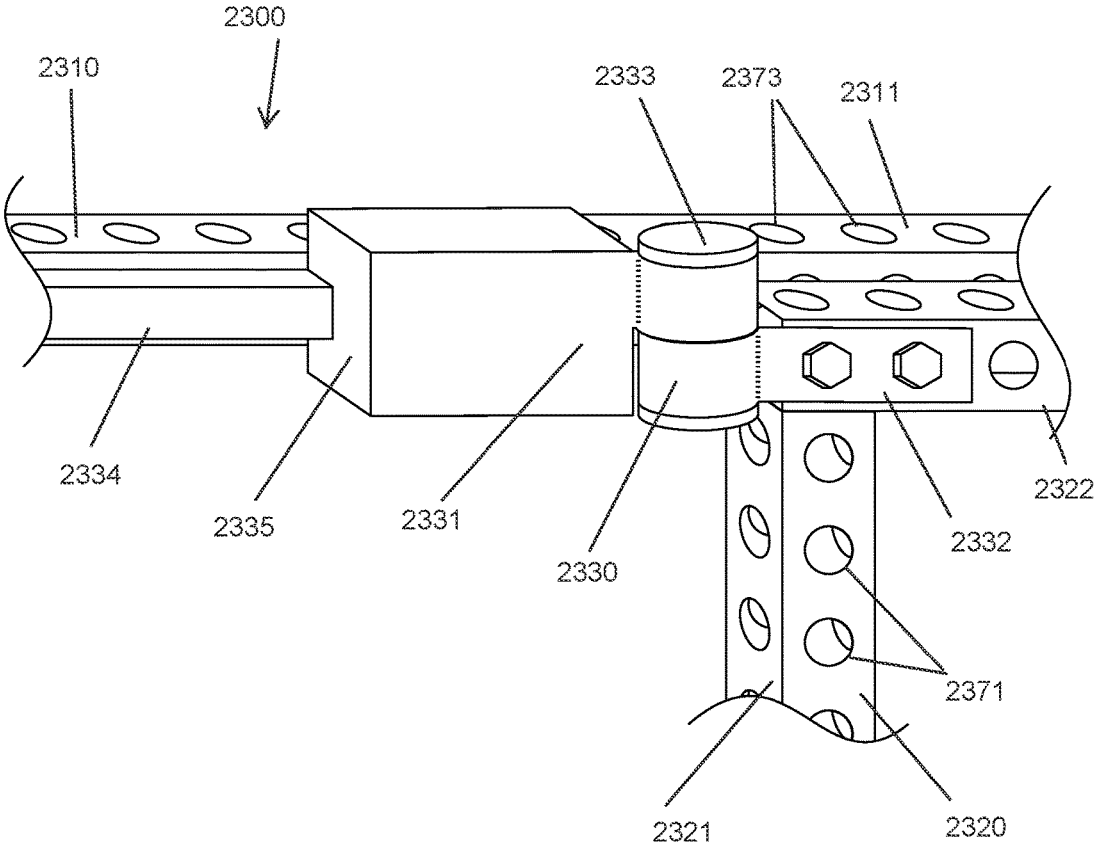
FIG. 23 depicts another embodiment of a slidably adjustable hinge.

FIG. 23 depicts another embodiment of a slidably adjustable hinge. Apparatus 2300 includes hinge 2330 set upon rail 2334 as positioned on frame 2310, specifically on horizontal member 2311. The hinge 2330 comprises frame brace 2331 rotatably joined to a door brace 2332 by a hinge axle 2333, wherein the frame brace 2331 is adapted to slidably engage rail 2334 affixed to frame 2310 of the apparatus 2300. Frame brace 2331 is adapted to slidingly engage rail 2334 with bearing housing guide 2335. Door 2320 comprises door horizontal member 2322 and door vertical member 2321 having door accessory receiving ports 2371. Frame 2310 comprises accessory receiving ports 2373. Door accessory receiving ports 2371 and accessory receiving ports 2373 provide anchor points for exercise attachment points such as pulleys providing a cable terminus and carabiner (not shown). Door 2320 is able to freely rotate about the hinge's 2330 hinge axle 2333 while also able to traverse along rail 2334. This can be described as door 2320 being pivotally and slidably mounted to frame 2310 in at least one point.

EMBODIMENTS

Embodiment 1. An apparatus for exercising against a resistance, comprising:

a frame, comprising a plurality of vertical members mutually supporting a plurality of horizontal members, wherein the frame has at least a front face joining a side face at a corner;

a door comprising one or more door vertical members mutually supporting one or more door horizontal members, the door being pivotally slidably, or both pivotally and slidably mounted to the frame in at least one point;

wherein the frame and optionally the door provide at least one exercise attachment point.

Embodiment 2. The apparatus of embodiment 1, wherein the frame defines a polygonal frame shape.

Embodiment 3. The apparatus of any one of embodiments 1-2, wherein the door defines a polygonal door shape.

Embodiment 4. The apparatus of any one of embodiments 1-3, wherein the door is of equal height to the frame.

Embodiment 5. The apparatus of any one of embodiments 1-4, wherein the door is of equal width to the frame.

Embodiment 6. The apparatus of any one of embodiments 1-3, wherein the door is of less than equal height to the frame.

Embodiment 7. The apparatus of any one of embodiments 1-4, wherein the door is of less than equal width to the frame.

Embodiment 8. The apparatus of any one of embodiments 1-7, further comprising an upper track, a lower track, or both, mounted on the side face; and the door is joined to the frame by the upper track, lower track, or both the upper track and the lower track, wherein the door is adapted to (a) obscure at least a portion of the front face in a closed position;

(b) slide along the side face by the upper track and the lower track;

(c) assume a plurality of secured open positions; or (d) any combination thereof.

Embodiment 9. The apparatus of embodiment 8, wherein the door is pivotally mounted to the upper track, lower track, or both the upper track and the lower track.

Embodiment 10. The apparatus of any one of embodiments 1-9, wherein the door vertical members comprise door accessory receiving ports.

Embodiment 11. The apparatus any one of embodiments 1-10, wherein the door horizontal members comprise door accessory receiving ports.

Embodiment 12. The apparatus of any one of embodiments 1-11, wherein the door has a door width; the front face has a front face width; and the door width is approximately one half of the front face width.

Embodiment 13. The apparatus of any one of embodiments 1-12, wherein the door is pivotally mounted to the frame at the upper track, the lower track, or both the upper track and the lower track, by at least one shaft.

Embodiment 14. The apparatus of any one of embodiments 1-13, wherein the door has a range of motion of no more than 90° relative to the front face of the frame.

Embodiment 15. The apparatus of any one of embodiments 1-13, wherein the door has a range of motion of no more than 120° relative to the front face of the frame.

Embodiment 16. The apparatus of any one of embodiments 1-13, wherein the door has a range of motion of no more than 180° relative to the front face of the frame.

Embodiment 17. The apparatus of any one of embodiments 1-13, wherein the door has a range of motion of no more than 270° relative to the front face of the frame.

Embodiment 18. The apparatus of any one of embodiments 1-17, wherein the frame comprises tubing which is square, triangular, rectangular, cylindrical, conical, hexagonal, or some combination thereof.

Embodiment 19. The apparatus of any one of embodiments 1-18, wherein the door comprises tubing which is square, triangular, rectangular, cylindrical, conical, hexagonal, or some combination thereof.

Embodiment 20. The apparatus of any one of embodiments 1-19, wherein the apparatus comprises wood, engineered wood, metal, structural polymers such as high-density polyalkanes, polyurethanes, nylons, perfluorinated polyalkanes such as Teflon® (polytetrafluoroethylene), and combinations thereof.

Embodiment 21. The apparatus of any one of embodiments 1-20, wherein the door comprises wood, engineered wood, metal, structural polymers such as high-density polyalkanes, polyurethanes, nylons, perfluorinated polyalkanes such as Teflon® (polytetrafluoroethylene), and combinations thereof.

Embodiment 22. The apparatus of any one of embodiments 20-21, wherein the metal is chosen from iron, aluminum, titanium, iron alloys, aluminum alloys, titanium alloys, and combinations thereof.

Embodiment 23. The apparatus of any one of embodiments 1-22, wherein the door defines a polygonal shape.

Embodiment 24. The apparatus of any one of embodiments 1-23, wherein the door contains a locking mechanism for allowing the apparatus to be locked in the closed position.

Embodiment 25. The apparatus of embodiment 1-24, further comprising at least one mechanical doorstop affixed to the door.

Embodiment 26. The apparatus of embodiment 25, wherein the mechanical doorstop comprises a kick lever with a boot.

Embodiment 27. The apparatus of embodiment 26, wherein the boot comprises wood, rubber, plastic, or a combination thereof.

Embodiment 28. The apparatus of embodiment 25, wherein the mechanical doorstop comprises a spring-loaded, foot-operated boot.

Embodiment 29. The apparatus of embodiment 28, wherein the boot comprises wood, rubber, plastic, or a combination thereof.

Embodiment 30. The apparatus of any one of embodiments 1-29, further comprising at least one exercise attachment point adjustably affixed to the frame.

Embodiment 31. The apparatus of any one of embodiments 1-30, further comprising at least one door exercise attachment point adjustably affixed to the door.

Embodiment 32. The apparatus of any one of embodiments 1-31, comprising at least one decorative panel mounted to the frame.

Embodiment 33. The apparatus of any one of embodiments 1-32, comprising at least one door decorative panel mounted to the door.

Embodiment 34. The apparatus of any one of embodiments 1-33, further comprising at least one weight stack.

Embodiment 35. The apparatus of embodiment 34, wherein the at least one weight stack is positioned in the frame.

Embodiment 36. The apparatus of any one of embodiments 34-35, wherein the at least one weight stack is positioned in the door.

Embodiment 37. The apparatus of any one of embodiments 34-36, wherein the at least one weight stack comprises a frame weight stack and a door weight stack, wherein the frame weight stack is positioned horizontally along bottom of the frame substantially centered relative to the front face and the side face.

Embodiment 38. The apparatus of any one of embodiments 1-37, further comprising at least one punching bag, speed bag, pull up bar, gymnastic ring, or a combination thereof.

Embodiment 39. The apparatus of any one of the preceding embodiments, wherein the door comprises at least one door diagonal member.

Embodiment 40. The apparatus of any one of the preceding embodiments, wherein the door comprises at least one door curved member.

Embodiment 41. The apparatus of any one of the preceding embodiments, wherein the door comprises at least one door member comprising at least one curving portion and at least one straight portion.

Embodiment 42. A hinge for an apparatus for storage of a variety of tools, comprising:

a frame brace rotatably joined to a door brace by a hinge axle, wherein the frame brace is adapted to slidably engage a track affixed to the frame of the apparatus.

Embodiment 43. The hinge of embodiment 42, wherein the frame brace is adapted to slidably engage the track with a track engagement member, comprising a tubular collar contained within the track.

Embodiment 44. The hinge of embodiment 43, wherein the track engagement member further comprises a ratchet and latch, the ratchet having ratchet teeth sized to allow an attached component to be set at multiple positions rotationally about the hinge axle.

Embodiment 45. The hinge of embodiment 44, wherein the ratchet and latch are adapted to allow for equal incremental positions from 0-270°, including but not limited to increments of 15°, 30°, 45°, 54°, 90°, or 180°.

Embodiment 46. The hinge of any one of embodiments 42-45, wherein the engagement member further comprises a hydraulically assisted operator.

Embodiment 47. The hinge of embodiment 46, wherein the hydraulically assisted operator comprises a hydraulic cylinder rigidly affixed to the door brace and a piston affixed to the door with a bracket and pin.

Embodiment 48. The hinge of any one of embodiments 45-47, wherein the hydraulically assisted operator is adapted to assist in positioning the door about the hinge in a clockwise direction.

Embodiment 49. The hinge of any one of embodiments 45-48, wherein the hydraulicly assisted operator is adapted to assist in positioning the door about the hinge in a counterclockwise direction.

Embodiment 50. A hinge for an apparatus for storage of a variety of tools, comprising:

a frame brace rotatably joined to a door brace by a hinge axle, wherein the frame brace is adapted to slidably engage a rail affixed to the frame of the apparatus.

Embodiment 51. The hinge of embodiment 50, wherein the frame brace is adapted to slidably engage the rail with a bearing housing guide.

Embodiment 52. The hinge of embodiment 51, wherein the hinge further comprises a ratchet and latch, the ratchet having ratchet teeth sized to allow an attached component to be set at multiple positions rotationally about the hinge axle.

Embodiment 53. The hinge of embodiment 52, wherein the ratchet and latch are adapted to allow for equal incremental positions from 0-270°, including but not limited to increments of 15°, 30°, 45°, 54°, 90°, or 180°.

Embodiment 54. The hinge of any one of embodiments 50-53, further comprising a hydraulically assisted operator.

Embodiment 55. The hinge of embodiment 54, wherein the hydraulically assisted operator comprises a hydraulic cylinder rigidly affixed to the door brace and a piston affixed to the door with a bracket and pin.

Embodiment 56. The hinge of any one of embodiments 50-55, wherein the hydraulically assisted operator is adapted to assist in positioning the door about the hinge in a clockwise direction.

Embodiment 57. The hinge of any one of embodiments 50-56, wherein the hydraulicly assisted operator is adapted to assist in positioning the door about the hinge in a counterclockwise direction.

Embodiment 58. A method of exercising against a resistance, optionally in a confined space, comprising:

obtaining an apparatus comprising:

a frame, comprising a plurality of vertical members mutually supporting a plurality of horizontal members, wherein the frame has at least a front face joining a side face at a corner;

one or more doors comprising one or more door vertical members mutually supporting one or more door horizontal members, the door being pivotally and slidably mounted to the frame in at least one point;

wherein the frame and optionally the door provide at least one exercise attachment point, and arrangement the apparatus and a variety of exercise equipment in a variety of positions.

Embodiment 59. The method of embodiment 55, wherein the apparatus is the apparatus of any one of embodiments 1-41.

Embodiment 60. The method of any one of embodiments 58-59, wherein a variety of exercise equipment can be adjustably positioned in a variety of positions, whereby a functionally equivalent exercise may be performed with substantially the same utility when the door is arranged in any of multiple possible positions.

Embodiment 61. The method of any one of embodiments 58-60, further comprising:

arranging the apparatus for at least one second exercise;

applying a second resistance to the apparatus; and exercising against the second resistance with the apparatus.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. An apparatus for exercising against a resistance, comprising:

a frame, comprising a plurality of vertical members mutually supporting a plurality of horizontal members, wherein the frame has at least a front face joining a side face at a corner;

a door comprising one or more door vertical members mutually supporting one or more door horizontal members, the door being pivotally, slidably, or both pivotally and slidably mounted to the frame in at least one point;

an upper track, a lower track, or both, mounted on the exterior of the side face;

and the door joined to the frame by the upper track, lower track, or both the upper track and the lower track, wherein the door is adapted to (a) obscure at least a portion of the front face in a closed position;

(b) slide along the side face by the upper track and the lower track;

(c) assume a plurality of secured open positions; or (d) any combination thereof;

wherein the frame and optionally the door provide at least one exercise attachment point.

2. The apparatus of claim 1, wherein the door is pivotally mounted to the upper track, lower track, or both the upper track and the lower track.

3. The apparatus of claim 2, wherein the door is pivotally mounted to the frame at the upper track, the lower track, or both the upper track and the lower track, by at least one shaft.

4. The apparatus of claim 1, wherein the frame defines a polygonal frame shape.

5. The apparatus of claim 1, wherein the door defines a polygonal door shape.

6. The apparatus of claim 1, wherein the door is of equal height to the frame.

7. The apparatus of claim 1, wherein the door is of equal width to the frame.

8. The apparatus of claim 1, wherein the door is of less than equal height to the frame.

9. The apparatus of claim 1, wherein the door is of less than equal width to the frame.

10. The apparatus of claim 1, wherein the one or more door vertical members comprise door accessory receiving ports, thereby providing anchor points for the at least one exercise attachment point.

11. The apparatus of claim 1, wherein the one or more door horizontal members comprise door accessory receiving ports, thereby providing anchor points for the at least one exercise attachment point.

12. The apparatus of claim 1, wherein the door has a door width, the front face has a front face width, and the door width is approximately one half of the front face width.

13. The apparatus of claim 1, wherein the door has a range of motion of no more than 90° relative to the front face of the frame.

14. The apparatus of claim 1, wherein the door has a range of motion of no more than 120° relative to the front face of the frame.

15. The apparatus of claim 1, wherein the door has a range of motion of no more than 180° relative to the front face of the frame.

16. The apparatus of claim 1, wherein the door has a range of motion of no more than 270° relative to the front face of the frame.

17. The apparatus of claim 1, wherein the plurality of vertical members, the plurality of horizontal members, or both the plurality of vertical members and the plurality of horizontal members comprises frame tubing that is square, triangular, rectangular, cylindrical, conical, hexagonal, or a combination thereof.

18. The apparatus of claim 1, wherein the one or more door vertical members, the one or more door horizontal members, or both the one or more door vertical members and the one or more door horizontal members comprises door tubing that is square, triangular, rectangular, cylindrical, conical, hexagonal, or a combination thereof.

19. The apparatus of claim 1, wherein the apparatus comprises wood, engineered wood, metal, one or more structural polymers, or a combination thereof.

* * * * *